United States Patent [19]

Hechler

[11] Patent Number: 4,605,213

[45] Date of Patent: Aug. 12, 1986

[54] APPARATUS FOR CONTINUOUS HANDLING OF FOLDED PAPER PRODUCTS

[75] Inventor: Hatto Hechler, Augsburg, Fed. Rep. of Germany

[73] Assignee: M.A.N. Roland Druckmaschinen Aktiengesellschaft, Offenbach am Main, Fed. Rep. of Germany

[21] Appl. No.: 756,779

[22] Filed: Jul. 18, 1985

[30] Foreign Application Priority Data

Jul. 26, 1984 [DE] Fed. Rep. of Germany ..... 3427558

[51] Int. Cl.[4] ..... B65H 5/30

[52] U.S. Cl. ..... 270/55; 198/485.1; 271/82; 271/193; 271/204; 271/277

[58] Field of Search ..... 270/53, 45, 54, 55, 270/56, 57, 58; 271/193, 208, 277, 82; 198/470.1, 485.1, 644

[56] References Cited

U.S. PATENT DOCUMENTS

| | | | |
|---|---|---|---|
| 3,423,900 | 1/1969 | Orsinger | 270/54 |
| 3,481,594 | 12/1969 | McCain et al. | 270/54 |
| 3,554,532 | 1/1971 | Cosgrove | 270/54 |
| 3,761,074 | 9/1973 | Benbener et al. | 271/193 |
| 3,897,051 | 7/1975 | Muller | 270/54 |
| 3,966,199 | 6/1976 | Silverberg | 271/193 |
| 3,987,498 | 9/1976 | Fletcher | 271/193 |
| 4,200,275 | 4/1980 | Wangermann | 270/55 |
| 4,447,146 | 5/1984 | Kogane et al. | 271/204 |
| 4,489,930 | 12/1984 | Meier | 270/55 |

*Primary Examiner*—E. H. Eickholt

*Attorney, Agent, or Firm*—Frishauf, Holtz, Goodman & Woodward

[57] ABSTRACT

The folded items (9) arriving from a folding apparatus (1) are grasped on the leading folded spine (10) by forward grippers (12) on an opening cylinder (8). Then the overhang (11) of each item is grasped by rearward grippers (13). Because of centrifugal force and optionally by means of an electrostatic charging device (7), the lower part of the folded item (9), after being released from the conveyor belts (5, 6), is repelled. As a result, rods (14) secured on a chain system (15) can be introduced, during their upward movement that is at a tangent to the opening cylinder (8), it between the two halves of one printed item, after which the transporting of the folded items (9) to further chain systems (such as 17) can be effected. Subsequently, folded items (9) can be collected one on top of the other and/or accelerated or delayed in accordance with how the transfer location is embodied.

9 Claims, 9 Drawing Figures

APPARATUS FOR CONTINUOUS HANDLING OF FOLDED PAPER PRODUCTS

The invention relates to an apparatus for further handling of the folded products produced in the folding apparatus of a rotary printing machine, including a device for opening the folded products.

Background

From German examined patent application DE-AS No. 29 10 964, it is known for the paper webs that have been printed in a printing machine, after they have been cut to size in a cutting apparatus, to be delivered to a folding apparatus, after which the further handling of collected folded products is effected on a so-called collective stapling or stitching machine. Naturally before the folded items are collected into sets, they must first be opened. In order to facilitate opening the partly finished products, that is, the folded items arriving from the folding apparatus, it is proposed that the pages located on one or the other side of the fold be joined adherently together; this requires an additional apparatus. From German examined patent application DE-AS No. 14 36 585, an apparatus is also known with the aid of which folded products can be opened. To this end, the folded items that are to be opened are pressed together with the aid of pressing bars, so that an insertion device can be introduced from the side. It will be appreciated that damage to the folded items or scratching of the fresh printing ink by the pressing bars cannot be precluded.

The Invention

It is the object of the invention to improve an apparatus of the above-described general type such that gentle opening of folded items and reliable and simple further guidance of the opened folded items are possible, so that the operations necessary for further handling, such as assembling of the partly finished products, can be performed reliably and gently.

Briefly, in accordance with the invention, the folded items are transferred from the folding apparatus by means of conveyor belts such that they can be grasped by the leading folded spine by forward grippers located on a rotating opening cylinder. Rearward grippers are located on the opening cylinder to grasp the overhang of the folded items. After the folded items have been grasped by the forward and rearward grippers, the half of the folded items remote from the opening cylinder moves away, due to centrifugal force, from the half held in the opening cylinder by the forward and rearward grippers. At least one of the rods, disposed at intervals on the revolving conveyor belt or chain system, and traveling approximately parallel past the opening cylinder can, upon approximately tangential upward movement, be introduced into the respective folded item, then being opened. Thereafter, the forward and rearward grippers, respectively, release the folded item. The folded items which are held by the rods can be transferred on rods of further conveyor belt systems or chain systems.

In the drawings, the following are shown, in each case schematically:

DETAILED DESCRIPTION

Figure 1:
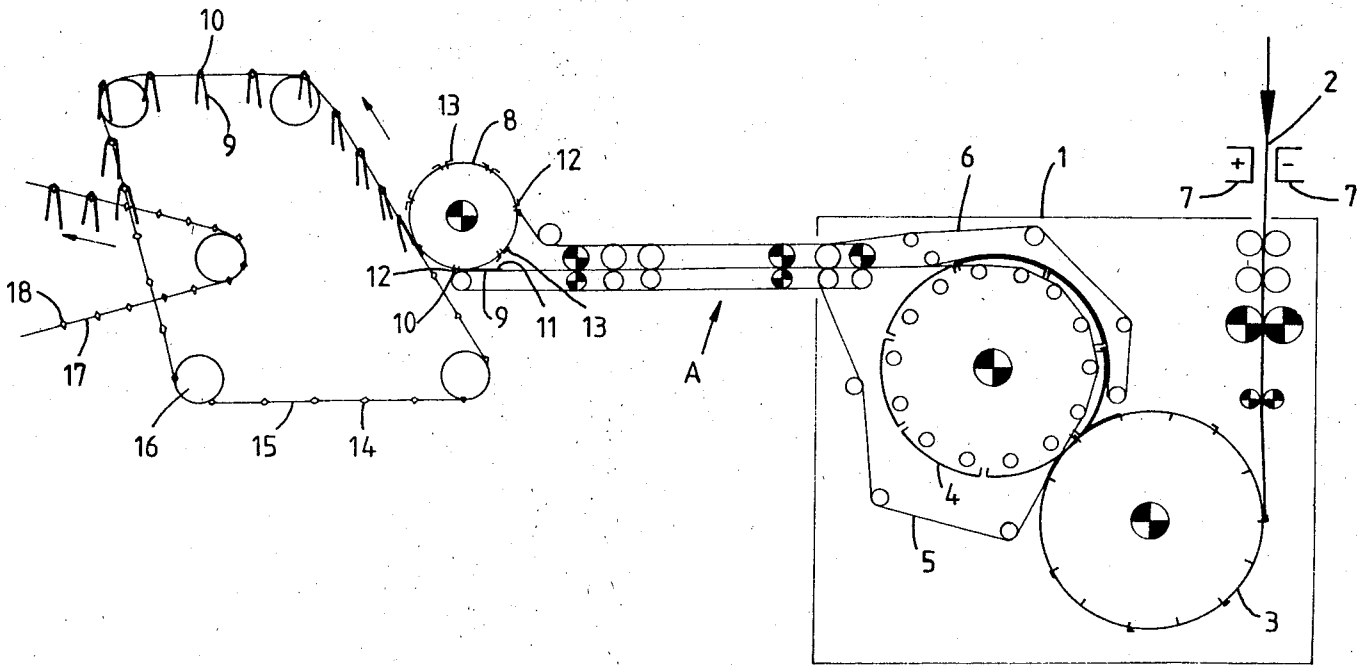
FIG. 1 depicts a device for opening and further transporting of folded items.

FIG. 1 is a schematic view of the entire apparatus, which includes a conventional folding apparatus 1, to which one or more webs of printed material 2 are delivered. These webs 2 of printed material have previously been printed on one or both sides in one or more colors by a conventional rotary printing machine, not shown. Optionally, a conventional dryer can also be used between the rotary printing machine, not shown, and the folding apparatus 1.

The folding apparatus 1 includes tension rollers, not identified by a reference numeral, and a cutting device as well as a collection cylinder 3 and a folding gripper cylinder 4. A lower conveyor belt 5 and an upper conveyor belt 6 lead from the folding gripper cylinder 4 to the following apparatus for further handling. As will be described in detail below, the folding apparatus may advantageously be preceded by an electrostatic charging device 7, with the aid of which the printed web 2 that is subsequently to be cut is electrostatically charged in such a way that the printed items coming from the folding apparatus 1, which are to be re-opened in an opening cylinder 8, have different charges on their two halves, so that they have the tendency to move away from each other.

After the printed web 2 has been cut to size, it is folded in the folding apparatus 1 such that the upper half of the folded item 9 is longer, with respect to the folded spine 10, than the lower half; that is, a so-called overhang 11 is formed. This is achieved in a simple manner in that the pieces of printed web that have been cut to size are not folded exactly in the middle, for instance as viewed in the longitudinal direction.

With the aid of the conveyor belts 5, 6, the folded items 9 provided with the overhang 11 are removed from the folding apparatus 1 with the folded spine 10 first and are delivered in a delayed manner to the rotating opening cylinder 8 according to the invention, because a delaying segment A is incorporated between the folding apparatus 1 and the opening cylinder 8. The opening cylinder 8 includes forward grippers 12 and rearward grippers 13 distributed about its circumference. As FIG. 1 shows, it is advantageous to provide a relatively large number of forward and rearward gripper pairs 12, 13 on the circumference of the opening cylinder 8.

The item arriving with its folded spine 10 in the lead is grasped by the forward gripper 12. As the opening cylinder 8 continues to rotate clockwise, the overhang 11 is grasped somewhat later by the rearward gripper 13. As a result, the upper half of the folded item 9 is fixed on the jacket of thee opening cylinder 8. At this moment, at the latest, the folded item 9 must be released from the conveyor belts 5, 6. Since the upper conveyor belt 6 is advantageously guided about the opening cylinder 8, this takes place automatically, in the embodiment according to FIG. 1.

Because of the rotation of the opening cylinder 8 after the release of the folded product 9 from the conveyor belts 5, 6, centrifugal force causes the lower half of the folded product 9 to move away from the upper half, which is firmly held by the grippers 12, 13. This operation of repelling the lower half of the folded products 9 is further reinforced, in an advantageous manner, by means of the above-mentioned electrostatic charging device 7 on the folding apparatus 1.

A chain system 15 used as a revolving transport system travels past the opening cylinder 8 with an ascending section in such a manner that the rods 14 disposed on the chain system 15, which travel past the opening cylinder 8 approximately axially parallel with it, each arrive at a point between the forced-apart portions of the folded item 9 at exactly this instant during each approximately tangential upward movement. The speed of the chain system 15 is matched to the speed of the conveyor belts 5, 6 as well as to the circumferential speed of the opening cylinder 8. As a result, one rod at a time can reliably and gently grasp one folded item 9, which has been opened by the opening cylinder 8, and carry it upward toward the top left as the chain system 15 moves counterclockwise. In the embodiments shown, only one chain transport system 15 is provided, approximately laterally in the vicinity of the end face of the opening cylinder 8, for receiving the folded items 9. In special cases, however, such chain systems 15 could also be used on both sides of the opening cylinder 8, the rods 14 of which would each have to point inward.

Preferably the rods 14 secured on the chains 15 are rotatable and have an approximately rhomboid cross section. As a result, by appropriately rotating the rods the folded items 9 can be grasped with the narrow sides, and after this—that is, after the opening cylinder 8—the rods 14 can be rotated, so that the halves of the folded items 9 can be forced apart, for the sake of the ensuing collection or assembling operation, by the wide side of the rhombus.

The chain system 15 shown in FIG. 1, which naturally can be replaced by a corresponding belt system, such as a toothed belt, is guided about four deflection or guide rollers, one of which, in this case the deflection roller 16, may be connected to a suitable drive mechanism.

Generally the folded items 9 arrive from the folding apparatus 1 at a relatively high speed, which must also be maintained when they are transferred to the chain system 15, unless the delaying segment A is inserted, by which means the speed can be reduced by approximately 60%. For the sake of further handling, however, it is favorable and often necessary for the speed to be reduced. This can be done when the folded items are transferred from the rods 14 of the chain system 15 to the rods of a slower-moving chain system 17. Then the intervals between the rods 18 which receive the printed items 9 and are secured on the chain system 17 must be smaller than the intervals between the rods 14 disposed on the faster-moving chain system.

Figure 2:
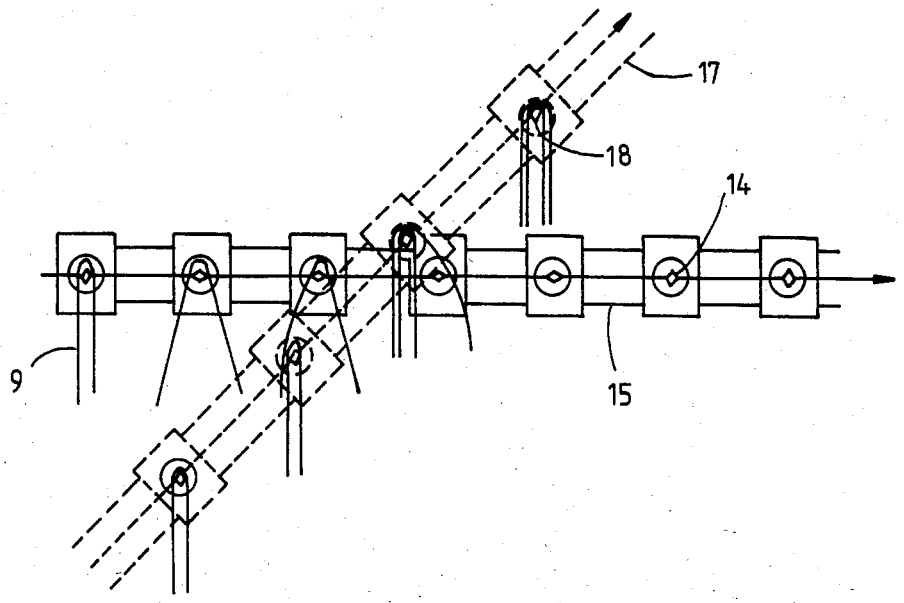
FIGS. 2 and 3 depict a side and front view of a transfer point for assembling folded items.
Figure 3:
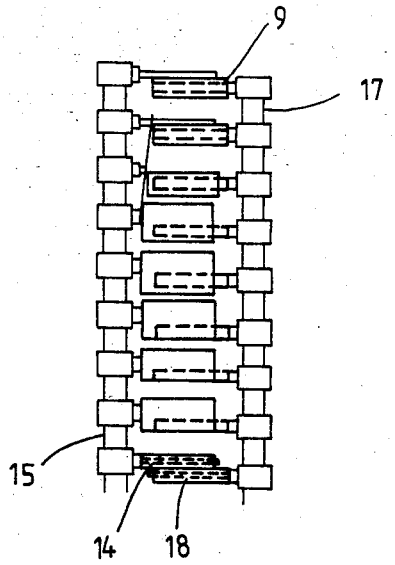

The transfer of the printed items 9 from the first chain system 15 can also be combined with a collecting operation at an intersection, as is shown in FIGS. 2 and 3. This collection operation takes place at a section of the chain system 15 that extends approximately horizontally. A further chain section of a chain system 17 extends obliquely from bottom left to top right, and printed items which have already been opened and sewn together are also suspended on this chain system from rods 18. As they travel past the associated rod 14, the rods 18 arriving from below receive the folded item 9 suspended from that rod 14. As shown in FIG. 2, prior to the transfer of the folded items 9 from the rods 14 to the rods 18, the rods 18 were rotated such that the printed items 9 hanging from them were either not spread apart or were spread apart only a little. This substantially facilitates transferring the printed items from the rods 14 to the rods 18. If needed, the transfer can also be effected, or facilitated, by means of an obliquely positioned guide plate, as indicated in FIG. 3. By combining various chain intersection systems, a plurality of partially finished products comprising folded items 9 can be placed one upon the other.

Figure 4:
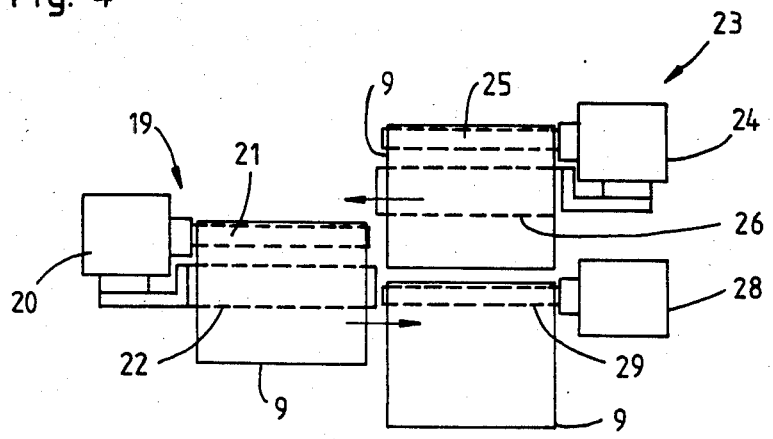
FIGS. 4 and 5 and FIG. 6 depict further embodiments of devices for transferring and collecting partly finished products.
Figure 5:
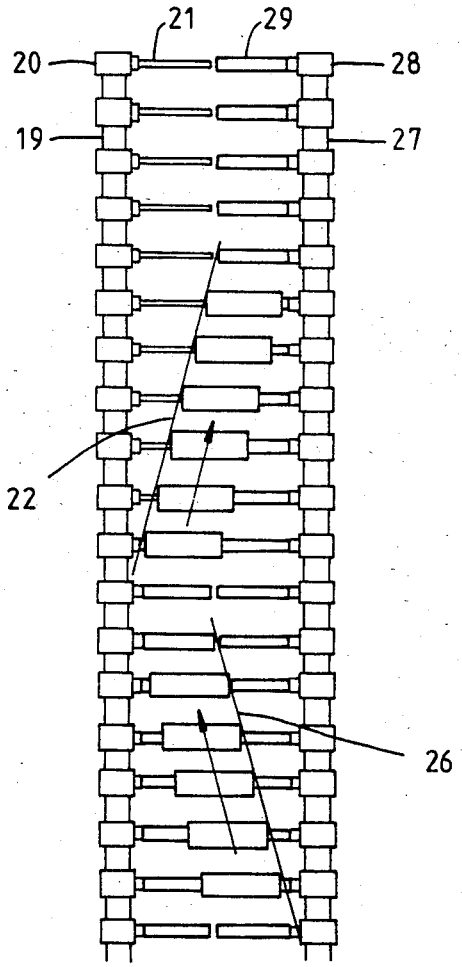

FIGS. 4 and 5 show an arrangement in which collection can be effected by displacement in the axial direction of the rods. To this end, the various partly finished products are moved in different planes by the chain systems in such a way that the open ends of the rods face each other. As shown best in FIG. 4, a chain system 19 is guided at a middle level, and holders 20 for the rods 21 and fixed guide plates 22 are secured on it. Holders 24 for the rods 25 and guide plates 26 are disposed on the chain system 23 that is guided at a higher level. The chain system 27 having the holders 28, on which the rods 29 are secured, is guided in the lowermost plane. The guide plate 26 is provided to displace the folded items 9 from the chain system 23 onto the chain system 19, or from the rods 25 onto the rods 21, while the folded items 9 can be pushed from the rods 21 onto the rods 29 by the guide plate 22. Multiple collection is thereby possible.

Figure 6:
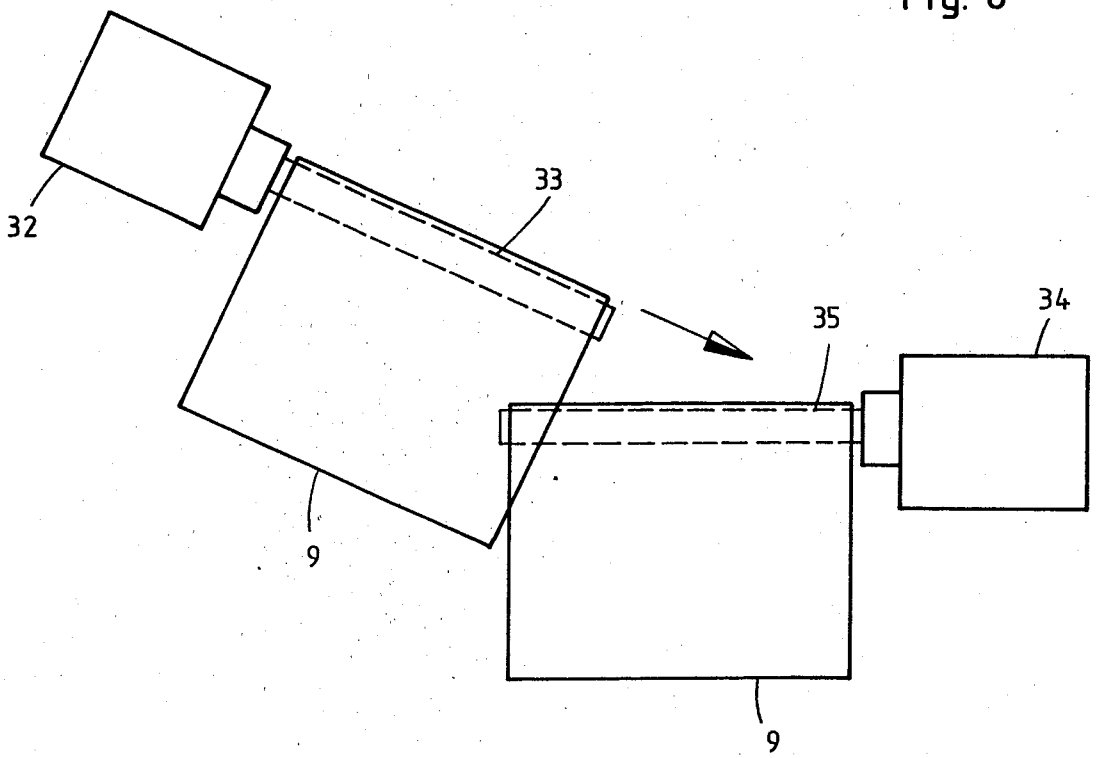

As compared with FIGS. 4 and 5, FIG. 6 shows a variant embodiment, in which the deflecting plates 22 and 26 are absent and the rods 33 secured on a chain system 32 are inclined, with respect to the approximately horizontally guided rods 35 secured on the chain system 34. As a result, without making further provisions, it is generally possible for the items 9 to drop onto the folded items 9 over the rods 35, perhaps with the aid of spreader devices.

Figure 7:
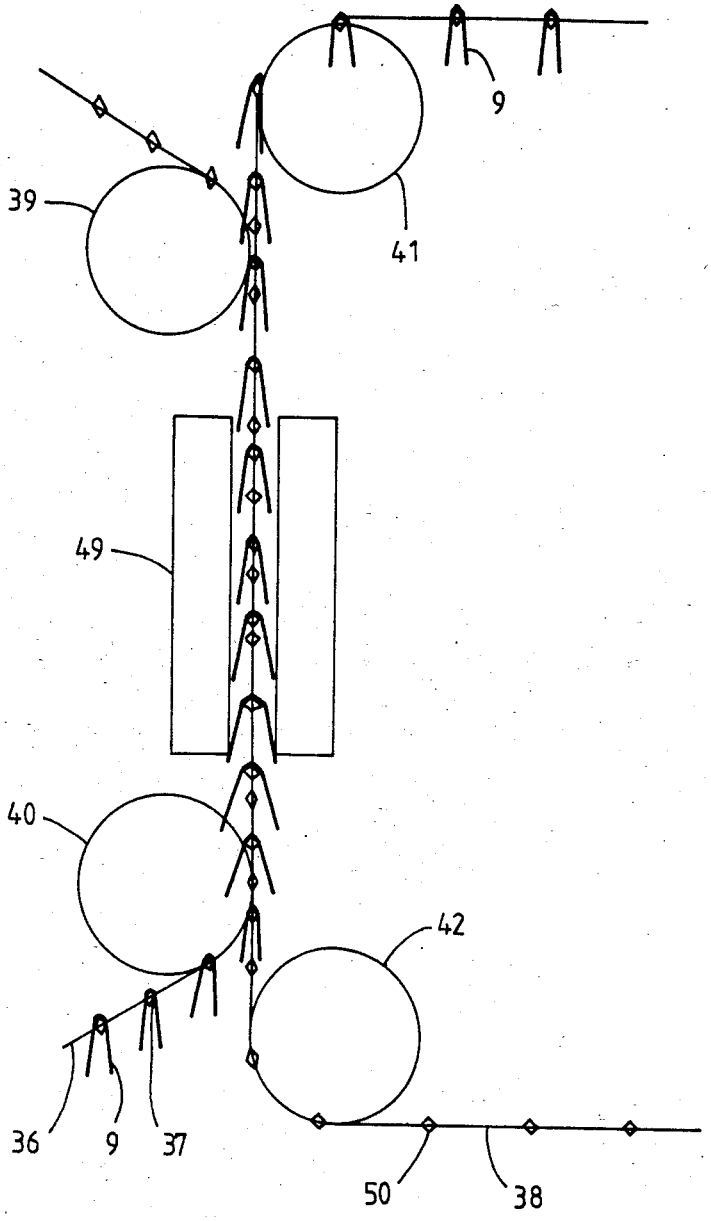
FIG. 7 depicts a device for speed reduction and for separating opened folded products.

An advantageous form of a transfer and delaying device, with which the various flows of products can also be divided, is shown in FIG. 7. A chain system 38 having rods 50 is guided parallel to a chain system 36 having rods 37. The chain system 38 travels at higher speed than the chain system 38. The intervals between the rods 37 on the chain system 36 are smaller than the intervals between the rods 50 on the chain system 38. The chain systems 36 and 38 are guided parallel, but one above the other, on guide or deflection rollers 39, 40, 41, 42. As a result, the folded items 9 can be transferred from the rods 37—for instance, all of them, or part of them—onto the rods 50 of the chain system 38, or vice versa. To facilitate the transfer, a transverse transport belt 49 having a rough surface can be inserted between the guide rollers 39 and 40 or 41 and 42. Thus with the apparatus according to FIG. 7, the printed items 9 can be delayed or accelerated, depending on the manner or direction of the transfer. Chain intersections journalled on only one end are naturally possible.

Figure 8:
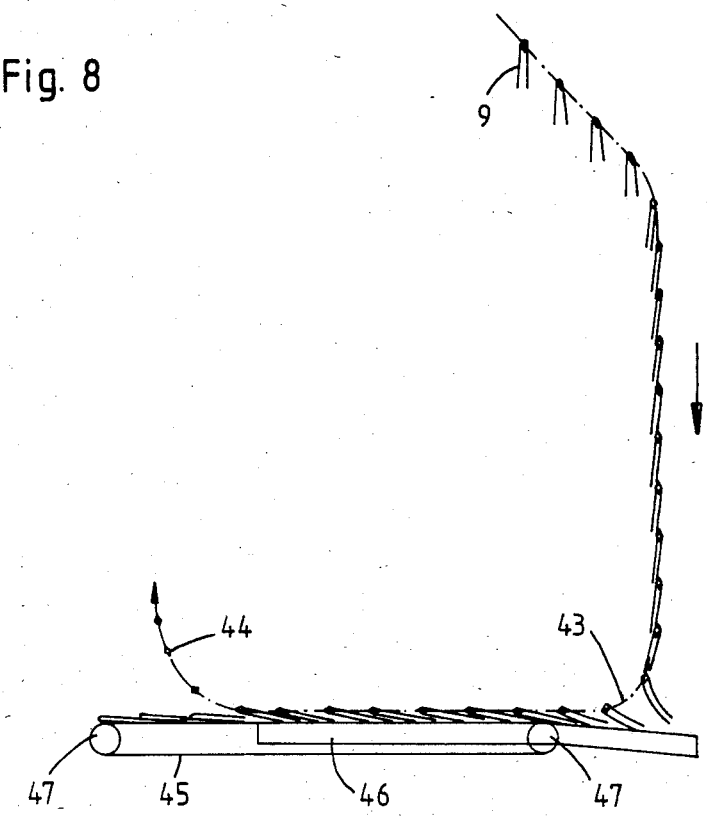
FIGS. 8 and 9 depict a device for paying out the folded items, which have been assembled into a finished product, on a conveyor belt in an imbricated manner.
Figure 9:
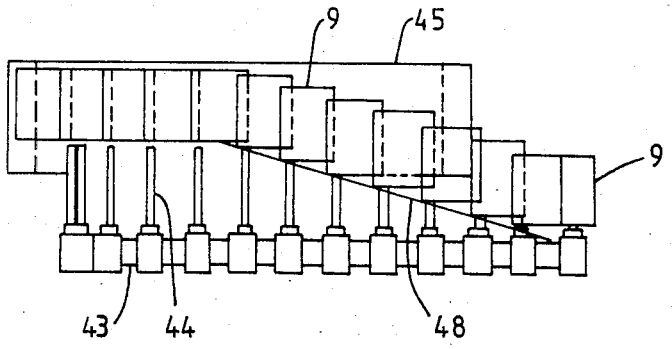

FIGS. 8 and 9 show an apparatus for paying out final products, assembled from folded items 9, in the form of an imbricated sequence. In paying them out, the applicable principle is that the ratio of the holder intervals (that is, of the imbrication or overlapping) is equal to the spacing of the number of sets paid out, and that this ratio must remain constant. The products suspended from rods 44 of a chain system 43 are paid out in an imbricated manner onto a paying out belt 45. The paying out belt 45 travels partly over a table 45 and is guided about deflecting rollers 47. With the aid of a deflector 48, the imbricated folded items 9 being paid out onto the belt 45 are forced away by the rods 44, so that they come to rest on the paying out belt 45 in an imbricated manner. Canting can be avoided by providing that the chain system 43 and the paying out belt 45 have the same speed.

A further advantage of the invention is that the collecting can be effected continuously and at low speed.

I claim:

1. Apparatus for further handling of the folded products produced in the folding apparatus of a rotary printing machine, having a device for opening these products, characterized in that the folded items (9) transferred from the folding apparatus (1) by means of conveyor belts (5, 6) can be grasped by the leading folded spine (10) by forward grippers (12) disposed on a rotating opening cylinder (8), that rearward grippers (13) disposed on the opening cylinder (8) grasp the overhang (11) of the folded items (9), that after the folded items (9) have been grasped by the forward and rearward grippers (12, 13), the half of the folded items (9) remote from the opening cylinder (8) moves away, because of centrifugal force, from the half held on the opening cylinder (8) by the forward and rearward grippers (12, 13), so that at least one of the rods (14 disposed at intervals on a revolving conveyor belt or chain system (15) and traveling approximately parallel past the opening cylinder (8) can, upon its approximately tangential upward movement, be introduced into the respective folded item (9) then being opened, after which the forward and rearward grippers (12, 13) respectively release the folded item (9) and the folded items (9) that are held by the rods (14) can be transferred onto rods (18) of further conveyor belt or chain systems (17).

2. Apparatus according to claim 1, characterized in that an electrostatic charging device (7) is disposed prior to the folding apparatus (1), by means of which the two halves of the folded items (9) are charged with opposite polarity, so that after the folded items (9) have been grasped by the forward and rearward grippers (12, 13) on the opening cylinder, the half of the folded items (9) that is remote from the opening cylinder (8) is repelled.

3. Apparatus according to claim 1, characterized in that the rods (14, 18) each have a rhomboid cross section and are rotatable.

4. Apparatus according to claim 1, characterized in that a plurality of pairs of forward and rearward grippers (12, 13) are distributed over the circumference of the opening cylinder (8).

5. Apparatus according to claim 1, characterized in that for collecting the folded items (8) suspended from the rods (14, 18) of different conveyor belt or chain systems (15, 17), a transfer intersection (FIGS. 2, 3) is provided, at which one conveyor belt or chain system (17) is moved obliquely from below through the other, horizontally extending conveyor belt or chain system (15), so that the respective rod (18) arriving from below receives the upper folded item (9) which has been spread apart by the rod (14) carrying it, and places it on the folded item (9) suspended from the lower rod (18).

6. Apparatus according to claim 1, characterized in that for collecting folded items (9), conveyor belt or chain systems (19, 27) journalled on one end are guided parallel but in different planes past each other in such a manner that the open ends of the rods (21, 29) face one another and that by means of guide plates (30, 31), the folded items are transferable from the rods (21) of one conveyor belt or chain system (19) to the rods (29) of the other conveyor belt or chain system (27) (FIGS. 4, 5).

7. Apparatus according to claim 1, characterized in that the rods (33) of a conveyor belt of chain system (32) are disposed above and inclined with respect to the rods (35) of the other conveyor belt or chain system (34), so that the folded items suspended from the rods (33) are capable of sliding onto the folded items (9) suspended from the rods (35) (FIG. 6).

8. Apparatus according to claim 1, characterized in that the transfer of the folded items (9) suspended from the rods (50) of a conveyor belt or chain system (38) revolving at a higher speed are transferable in a parallel guide section formed by guide rollers or chain wheels (39, 40; 41, 42) onto the rods (37) of a conveyor belt or chain system (36) revolving at a lower speed, wherein the intervals between the rods (37) of the slower-moving conveyor belt or chain system (36) are closer together than the rods (50) of the faster-moving conveyor belt or chain system (38) and that a transverse conveyor belt (49) having a rough surface is disposed on both sides of the common, parallel transfer section.

9. Apparatus according to claim 1, characterized in that the folded items of one paying out conveyor belt or chain system, which are collected and resting one on top of the other on the rods (44), are paid out in an imbricated manner onto a paying out belt (45) over an approximately horizontally extending guide section, and the folded items (9) are pushed downward from the rods (49) by a deflector (48) disposed obliquely above the paying out belt (45).

* * * * *